US008456287B2

(12) United States Patent
Gifford et al.

(10) Patent No.: US 8,456,287 B2
(45) **Date of Patent: *Jun. 4, 2013**

(54) INDICATOR SYSTEM FOR A MEDICATION CONTAINER

(76) Inventors: Barbara K. Gifford, Siloam Springs, AR (US); Joseph D. Gifford, Siloam Springs, AR (US)

( * ) Notice: Subject to any disclaimer, the term of this patent is extended or adjusted under 35 U.S.C. 154(b) by 954 days.

This patent is subject to a terminal disclaimer.

(21) Appl. No.: 12/494,256

(22) Filed: Jun. 29, 2009

(65) Prior Publication Data

US 2009/0314680 A1 Dec. 24, 2009

Related U.S. Application Data

(63) Continuation of application No. 11/725,490, filed on Mar. 19, 2007, now Pat. No. 7,554,434.

(51) Int. Cl.

| | |
|---|---|
| ***G08B 1/00*** | (2006.01) |
| ***G08B 23/00*** | (2006.01) |
| ***A61J 1/00*** | (2006.01) |

(52) U.S. Cl.
USPC ..... 340/309.16; 340/309.7; 340/573.1; 368/1; 368/10; 206/459.5; 206/534; 215/201; 215/230; 215/DIG. 3

(58) Field of Classification Search
USPC ..... 340/309.16, 309.7; 215/201
See application file for complete search history.

(56) References Cited

U.S. PATENT DOCUMENTS

| | | | | |
|---|---|---|---|---|
| 5,815,586 | A | 9/1998 | Dobbins | |
| 5,852,590 | A | 12/1998 | de la Huerga | |
| 6,667,936 | B1 | 12/2003 | Ditzig | |
| 7,554,434 | B1 * | 6/2009 | Gifford et al. | 340/309.16 |
| 2006/0071011 | A1 | 4/2006 | Varvarelis et al. | |

* cited by examiner

*Primary Examiner* — Donnie Crosland
(74) *Attorney, Agent, or Firm* — Invention Protection Associates, LLC

(57) ABSTRACT

An indicator system for use on a medicine bottle to indicate the times and dates of the last dosage taken and the next dosage to be taken, including means for registering time and date when the bottle is opened and then closed.

12 Claims, 1 Drawing Sheet

INDICATOR SYSTEM FOR A MEDICATION CONTAINER

This non-provisional application is a continuation and claims the benefit of non-provisional application Ser. No. 11/725,490 filed Mar. 19, 2007, now U.S. Pat. No. 7,554,434.

BACKGROUND OF THE INVENTION

Present medical drugs have a predetermined therapeutic range in which the effects of taking the drug are beneficial. Under utilization of a drug may endanger the user with the drug's side effects without reaching levels necessary for a therapeutic action. On the other hand, over utilization may cause side effects or toxicity to a much greater extent than any possible benefit. Thus is critically important that a patient follow prescribed directions on medications, yet, frequently patients forget whether they have taken medication and either omit doses or repeat them. One of the major factors in a patient's non-compliance with the taking of medication is the problem of not remembering whether the medication was taken at the last scheduled dosage time.

This problem is particularly severe for elderly patients who are generally beset with multiple ailments requiring numerous drugs and directions. The fading memory and confusion that come with age further compound the problem. Oftentimes, elderly patients could well lead independent self-sufficient lives but for their inability to follow a therapeutic regimen necessary to their health and well-being. Caps of the "reminder" type will be an important adjunct in drug therapy as the number of elderly people increases and new potent drugs are utilized.

A considerable number of pill-timing schemes have been used to solve the problem of reminding a patient to take a dose of medicine or reminding him he has already taken that dose. The most used ones involve some scheme of compartmentalization of the necessary medication, such that the pills are placed in compartments labeled as to day, to dose number or time of day, or serially numbered. These devices are reasonably satisfactory if a responsible person is available and has the time and patience to fill the compartments properly.

Therefore, there is a need for a pill storage and dispensing device that will remember a pill taking regimen as well as remind a user that it is time to take medicine.

SUMMARY OF THE INVENTION

The present invention relates to the general art of dispensing containers, and to the particular field of dispensing containers for medicine.

These, and other, objects are achieved by an indicator system for use on a medicine bottle to indicate the time and date of the last dosage. The system includes means for registering time and date when the bottle is opened and then closed. The system can also include an alarm.

DETAILED DESCRIPTION OF THE PREFERRED EMBODIMENTS

Figure 2:
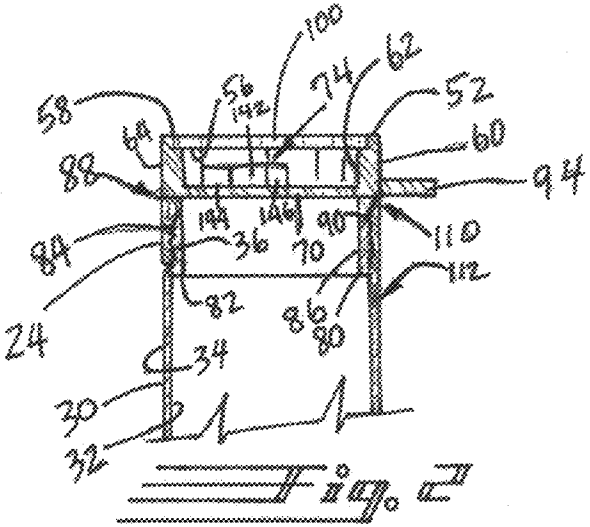
FIG. 2 is a view taken along line A-A of FIG. 1.
Figure 3:
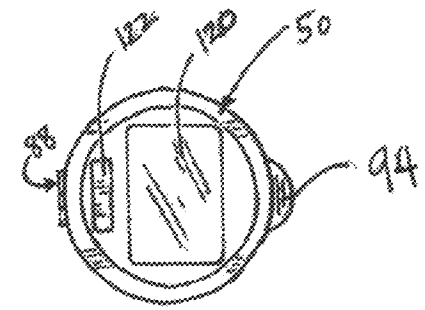
FIG. 3 is a top plan view of the bottle shown in FIG. 1.
Figure 1:
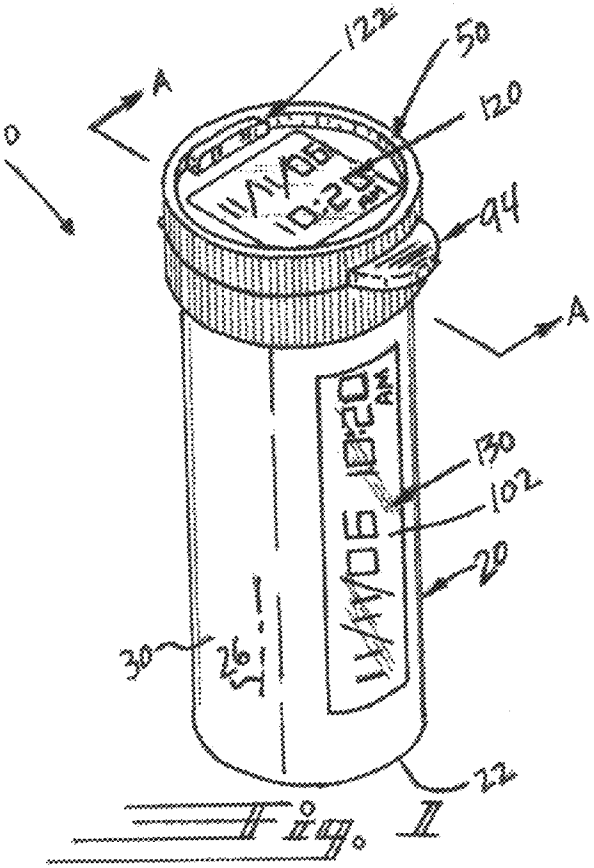
FIG. 1 is a perspective view of a perspective view of a medicine bottle having thereon the indicator system embodying the present invention.

Other objects, features and advantages of the invention will become apparent from a consideration of the following detailed description and the accompanying drawings. Referring to the accompanying figures, it can be understood that the present invention is embodied in a medicine container 10 which alerts a user as to when it is time to take medicine and then maintains a record of when medicine was last taken.

A container 10 comprises a container body 20 that includes a first end 22 which forms a bottom end when the body 20 is in use, a second end 24 which forms a top end when the body 20 is in use, and a longitudinal axis 26 which extends between the first and second ends 22, 24. A sidewall 30 connects the first end 22 to the second end 24. The sidewall 30 has an inner surface 32 and an outer surface 34. A screw thread 36 is located on the inner surface 32 near the second end 24 of the body 20.

A container cap 50 mounts onto the second end 24 of the body 20 when in use, and it includes a first surface 52 which is a top surface when the cap 50 is in use. The first surface 52 has an inner surface 56 and an outer surface 58. A cap sidewall 60 extends from the first surface 52 of the cap 50 and has an inner surface 62, an outer surface 64 and an end 66 which is spaced apart from top surface 52 of the cap 50. A mid-wall 70 is mounted on the inner surface 56 and is spaced apart from the top surface 52 of the cap 50. A chamber 74 is defined by the inner surface 56 of the top wall of the cap 50 and mid-wall 70 and inner surface 62 of the sidewall of the cap 50.

A skirt 80 has a rim 82, an outer surface 84 and an inner surface 86. The skirt and the rim of the skirt are located adjacent to inner surface 32 of the sidewall of the body when the cap 50 is in place on the body as can be understood from FIG. 2. A hinge 88 connects the skirt to the sidewall of the cap 50. A screw thread 90 is defined on outer surface 84 of the skirt of the cap 50 and extends from rim 82 of the skirt to adjacent to mid wall 70 of the cap 50 and threadably engages the screw thread on the container body when the cap 50 is in use to securely mount the cap 50 on the body. An opening tab 94 is mounted on the outer surface of the sidewall. The opening tab is located to be co-planar with the mid wall of the cap 50. A first translucent window 100 is located in the top surface of the cap 50 adjacent to the chamber defined in the cap 50 and a second translucent window 102 located in the sidewall of the body.

A first proximity sensor element 110 is positioned in the sidewall of the cap 50 and a second proximity sensor element 112 is located in the sidewall of the body. The first and second proximity sensors are located closely adjacent to each other when the cap 50 is in place on the body and are separated from each other when the cap 50 is removed from the body. An alarm time and date display 120 is located to be visible in the first translucent window and displays preset time and preset date when a user is to take medicine. Control buttons 122 are located on the top surface of the cap 50 and are used to set the alarm display.

A record time and date display 130 is located in the second translucent window and is associated with the first and second proximity sensor elements to display the time and date the cap 50 was last removed from the body as an indication of when medicine was last taken. A circuit control unit 140 is located in the chamber in the cap 50 and includes an alarm circuit 142 which connects the alarm display with the alarm time and date display. A record circuit 144 connects the first and second proximity sensor elements with the record time and date display. A third circuit 146 connects the control buttons to the alarm circuit 142.

Whenever the cap 50 is removed from the body and then replaced, the record time and date circuits are activated and the record time and date displays are changed appropriately, whereby a user will know when the medicine was last taken.

The alarm circuit 142 will alert the user when it is time to take medicine. The time and date circuits of both the alarm system and the record system can be reset and reactivated as needed.

It is understood that while certain forms of the present invention have been illustrated and described herein, it is not to be limited to the specific forms or arrangements of parts described and shown.

What is claimed is:

1. An indicator system for a medication container having a body and removable cap, the system comprising:

first and second proximity sensors that are located closely adjacent to each other when the cap is secured to the body and are moved further apart as the cap is unsecured from the body;

a first display showing a first time, wherein the first time indicates when medication should be next taken by a user; and a second display showing a second time, wherein the second time indicates when the cap was last unsecured from the body and, therefore, may further indicate when the user last took medication.

2. The indicator system of claim 1, further comprising a processor arrangement for providing communication between at least one of said proximity sensors and said second display, wherein the processor arrangement identities said second. time by identifying when said proximity sensors are separated beyond a certain distance, and it communicates said second time to said second display.

3. The indicator system of claim 2, wherein said processor arrangement comprises a circuit that operatively connects at least one of said proximity sensors to said second display.

4. The indicator system of claim 1, further comprising an alarm that is actuated at said first time, wherein said first time is user-settable.

5. The indicator system of claim 4, further comprising at least one user input module for setting said alarm.

6. The indicator system of claim 5, further comprising a processor arrangement for providing communication between said user input module(s) and said alarm and between at least one of said proximity sensors and said second display, wherein the processor arrangement identifies said second time by identifying when said proximity sensors are separated beyond a certain distance, and it communicates said second time to said second display.

7. The indicator system of claim 6, wherein said processor arrangement comprises:

a first circuit that operatively connects said input module(s) to said first display; and a second circuit that operatively connects at least one of said proximity sensors to said second display.

8. A medication container comprising:

a body for holding medication;

a cap that secures to the body;

a first proximity sensor disposed on the cap;

a second proximity sensor disposed on the body, wherein the first and second proximity sensors are located closely adjacent to each other When the cap is secured to the body and are moved further apart as the cap is unsecured from the body;

a first display showing a first time, wherein the first time indicates when medication should be next taken by a user;

a second display showing a second time, wherein the second time indicates when the cap was last unsecured from the body and, therefore, may further indicate when the user last took medication;

an alarm that is actuated at said first time, wherein said first time is user-settable; and a user input module fur setting said alarm.

9. The medication container of claim 8, further comprising a processor arrangement for providing communication between said user input module(s) and said alarm and between at least one of said proximity sensors and said second display, wherein the processor arrangement identities said second time by identifying when said proximity sensors are separated beyond a certain distance, and it communicates said second time to said second display.

10. The medication container of claim 9, wherein said processor arrangement comprises:

a first circuit that operatively connects said input module(s) to said first display; and a second circuit that operatively' connects at least one of said proximity sensors to said second display.

11. The medication container of claim 8, further comprising a processor arrangement for providing communication between at least one of said proximity sensors and said second display, wherein the processor arrangement identifies said second time by identifying when said proximity sensors are separated beyond a certain distance, and it communicates said second time to said second display.

12. The medication container of claim 11, wherein said processor arrangement comprises a circuit that operatively connects at least one of said proximity sensors to said second display.

* * * * *